US008262192B2

(12) United States Patent
Matsumoto

(10) Patent No.: US 8,262,192 B2
(45) Date of Patent: Sep. 11, 2012

(54) INK JET PRINTER FOR PRINTING ELECTROMAGNETIC WAVE CURING INK

(75) Inventor: Nobuo Matsumoto, Cupertino, CA (US)

(73) Assignee: FUJIFILM Corporation, Tokyo (JP)

( * ) Notice: Subject to any disclaimer, the term of this patent is extended or adjusted under 35 U.S.C. 154(b) by 640 days.

(21) Appl. No.: 12/372,477

(22) Filed: Feb. 17, 2009

(65) Prior Publication Data

US 2010/0208020 A1 Aug. 19, 2010

(51) Int. Cl.
*B41J 2/01* (2006.01)
*B41J 2/165* (2006.01)

(52) U.S. Cl. ..... 347/25; 347/22; 347/102

(58) Field of Classification Search ..... 347/102, 347/22, 25, 101, 97
See application file for complete search history.

(56) References Cited

U.S. PATENT DOCUMENTS

| | | | | |
|---|---|---|---|---|
| 4,369,450 | A * | 1/1983 | Iwagami et al. | 347/34 |
| 4,591,869 | A * | 5/1986 | Katerberg et al. | 347/21 |
| 5,798,774 | A | 8/1998 | Okada et al. | |
| 5,877,788 | A * | 3/1999 | Haan et al. | 347/28 |
| 6,347,858 | B1 * | 2/2002 | Faisst et al. | 347/22 |
| 6,390,618 | B1 * | 5/2002 | Wotton et al. | 347/102 |
| 6,491,364 | B2 | 12/2002 | Pietrzyk et al. | |
| 6,719,398 | B1 * | 4/2004 | McElfresh et al. | 347/21 |
| 7,470,016 | B2 | 12/2008 | Baker et al. | |
| 7,604,332 | B2 * | 10/2009 | Nagashima | 347/84 |
| 2003/0156152 | A1 * | 8/2003 | Ray et al. | 347/25 |
| 2004/0070645 | A1 * | 4/2004 | Garbacz et al. | 347/25 |
| 2005/0099467 | A1 | 5/2005 | Bibl et al. | |
| 2005/0190248 | A1 | 9/2005 | Konno et al. | |
| 2005/0241678 | A1 * | 11/2005 | Mori | 134/34 |
| 2007/0273739 | A1 * | 11/2007 | Rodin et al. | 347/102 |

FOREIGN PATENT DOCUMENTS

| | | | |
|---|---|---|---|
| JP | 62218140 | A * | 9/1987 |
| JP | 05077437 | A * | 3/1993 |
| JP | 2003-285424 | | 10/2003 |
| JP | 2003-285425 | | 10/2003 |
| JP | 2006-068937 | | 3/2006 |
| JP | 2006-110895 | | 4/2006 |
| JP | 2008087272 | A * | 4/2008 |

OTHER PUBLICATIONS

Machine Translation for JP2008087272A.*

* cited by examiner

*Primary Examiner* — Stephen Meier
*Assistant Examiner* — Leonard S Liang
(74) *Attorney, Agent, or Firm* — Fish & Richardson P.C.

(57) ABSTRACT

A printing device has a gas source, a printhead having a nozzle plate with nozzles in the nozzle plate, the nozzles are fluidly connected to corresponding pumping chamber and a gas outlet positioned adjacent to the nozzle plate. The gas outlet is in fluid communication with the gas source and the gas outlet is configured to provide gas to an exposed surface of the nozzle plate so that the gas flow is substantially parallel to the surface of the nozzle plate. Fluid that is ejected out of the nozzles has a UV curable component. After the fluid has been ejected out of the nozzle and onto a receiver, the fluid is irradiated and cured.

23 Claims, 6 Drawing Sheets

INK JET PRINTER FOR PRINTING ELECTROMAGNETIC WAVE CURING INK

TECHNICAL FIELD

This invention relates to printing electromagnetic wave curing ink.

BACKGROUND

Ultra violet light curable inks, referred to herein as UV ink, are frequently used in printing because they can provide a number of advantages, such as high opacity, water resistance, flexibility, chemical resistivity and good adhesion to non-porous substrates. A UV ink can be applied to a substrate in a solution form and then irradiated with UV light in order to cure the ink into a solid form. Some types of UV ink are solutions that include monomers, oligomers and a photoinitiator, which in combination with the UV radiation, cures the ink. The photoinitiator can absorb UV energy and break into reactive materials that then polymerize or crosslink components in the UV ink. Both free radicals and cationic type photoinitiators are used in UV inks, with the free radical type being more common. Free radical photoinitiator reactions do not continue after the UV energy source is removed.

UV inks can be applied to the desired substrate by using a number of printing processes, such as a screen printing process or ink jet printing process. Ink jet printers typically can be categorized as continuous flow type printers or drop on demand type printers. Ink jet printers also can either have printheads with a limited number of nozzles and that scan the width of the substrate during printing or that are fixed, such as in a page width printing device. Drop on demand type printers that have page width print heads or print bars have multiple nozzles, with some nozzles being fired less frequently than other nozzles during printing.

SUMMARY

In one aspect, printing device is described that includes a gas source, a printhead and a gas outlet. The printhead has a nozzle plate with nozzles in the nozzle plate, wherein the nozzles are fluidly connected to corresponding pumping chambers. The gas outlet is positioned adjacent to the nozzle plate. The gas outlet is in fluid communication with the gas source and the gas outlet is configured to provide gas to an exposed surface of the nozzle plate so that the gas flow is substantially parallel to the surface of the nozzle plate.

In another aspect, a printing device is described that has a vacuum source, a gas source, a printhead, a gas outlet and an inlet. The printhead has a nozzle plate with nozzles fluidly connected to corresponding pumping chambers. The gas outlet is positioned adjacent to the nozzle plate. The gas outlet is in fluid communication with the gas source. The inlet is positioned adjacent to the nozzle plate and on an opposite side from the gas outlet. The inlet is in fluid communication with the vacuum source.

In another aspect, a printing device is described that has a gas source, a printhead and a gas outlet. The printhead has a nozzle plate with nozzles in a surface. The nozzles are fluidly connected to corresponding pumping chambers and the surface is exposed. The gas outlet is in the nozzle plate. The gas outlet is in fluid communication with the gas source and is separate from the nozzles.

In yet another aspect, a printing device is described that has a vacuum source, a gas source, a printhead, a gas outlet and an inlet. The printhead has a nozzle plate with nozzles fluidly connected to corresponding pumping chambers. The gas outlet is in the nozzle plate. The gas outlet is in fluid communication with the gas source. The inlet is positioned adjacent to the nozzle plate. The inlet is in fluid communication with the vacuum source.

Methods of using the printheads can include ejecting fluid from the printhead of the printing device along a trajectory and onto a receiver. While ejecting the fluid from the nozzle, flowing oxygen containing gas across the nozzle plate at a rate sufficiently low to prevent the flowing from changing the trajectory of fluid ejection.

Embodiments of the systems and techniques described herein can include one or more of the following features. The gas source can be configured to supply gas at a rate of less than 2 m/s. The gas outlet can be configured to provide laminar gas flow when gas is provided from the gas source. One edge of the nozzle plate can form a part of the gas outlet. At least one edge of the nozzle plate along the surface can be rounded or chamfered. The printing device can be a drop on demand type printing device. A UV light source can be adjacent to the printhead, such as within 10 centimeters or within 5 centimeters of the printhead. Ejecting fluid can include ejecting UV curable ink. The UV curable ink that has been ejected from the nozzle and onto the receiver can be irradiated. Flowing oxygen containing gas can include blowing the oxygen containing gas out the outlet and suctioning the oxygen containing gas in at an inlet. Flowing the oxygen containing gas can include flowing gas that has more than 21% oxygen across the printhead.

One or more advantages may be provided by devices and techniques described herein. UV ink can be jetted onto a substrate and cured quickly after deposition. Curing may occur prior to the UV ink having a chance to spread beyond the location in which the ink was applied. Quick curing can therefore allow for sharper printing of an image than curing a longer time after the ink has been applied to the receiver. Because oxygen containing gas, such as air, on the surface of the jetted UV ink retards curing the UV ink, inert gas or gas that is oxygen free, such as nitrogen gas, can be supplied on the UV ink that has been applied to a substrate that is placed under a UV light source to cure the ink. However, oxygen free gas may diffuse and cover the surface of the printhead and this can facilitate the ink on the surface of the printhead curing. Providing oxygen containing gas over a surface of the printhead can prevent ink from curing on the surface of the printhead. Thus, the printhead can be kept clear of cured ink. Preventing ink from curing in and around nozzles in the printhead can maintain the nozzles open. Uniformly open nozzles across a printhead can maintain printing uniformity, both in term of droplet size and droplet directionality, between nozzles in a printhead. In addition, post-printing maintenance need not include removing cured ink from the printhead, such as by scraping or chemical treatment, or even needing to replace a printhead due to having cured ink on the surface or in the nozzles.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Flowing an oxygen containing gas over the nozzles of a drop on demand ink jet printer during printing or device standby to prevent ink curing in and around the nozzles can prevent blockage and maintain printing quality. The fluid contains sufficient oxygen gas, such as air, air enriched in oxygen or pure oxygen, to prevent UV ink curing. A printhead can include passages through which fluid is directed, and nozzles in fluid communication with the passages. The fluid is ejected out of the nozzles and onto a receiver. Because drop on demand printers have nozzles that may be fired less frequently than other nozzles in a single printhead, flowing oxygen containing gas over the nozzles in a printhead that is in a drop on demand type printer can prevent clogging in infrequently fired nozzles. Such a printer can include printbars with one or more printheads, where nozzles are formed in the printheads so that ink can be deposited across an entirety of a width of a receiver being printed upon (e.g., paper, glass, plastic sheeting, etc.). If a printhead includes multiple printheads, the printheads can be positioned approximately end to end with one another.

Figure 1:
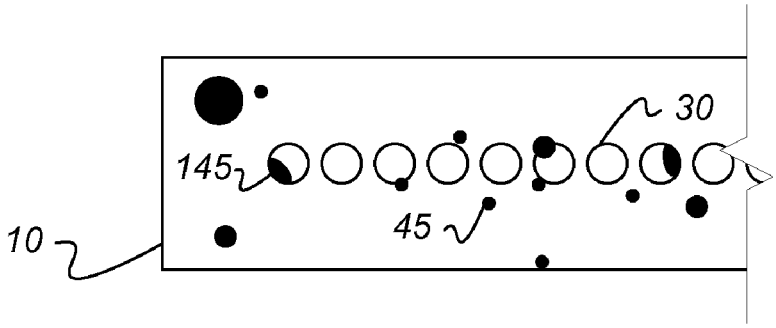
FIG. 1 schematically shows a printhead with cured ink on the surface.
Figure 2:
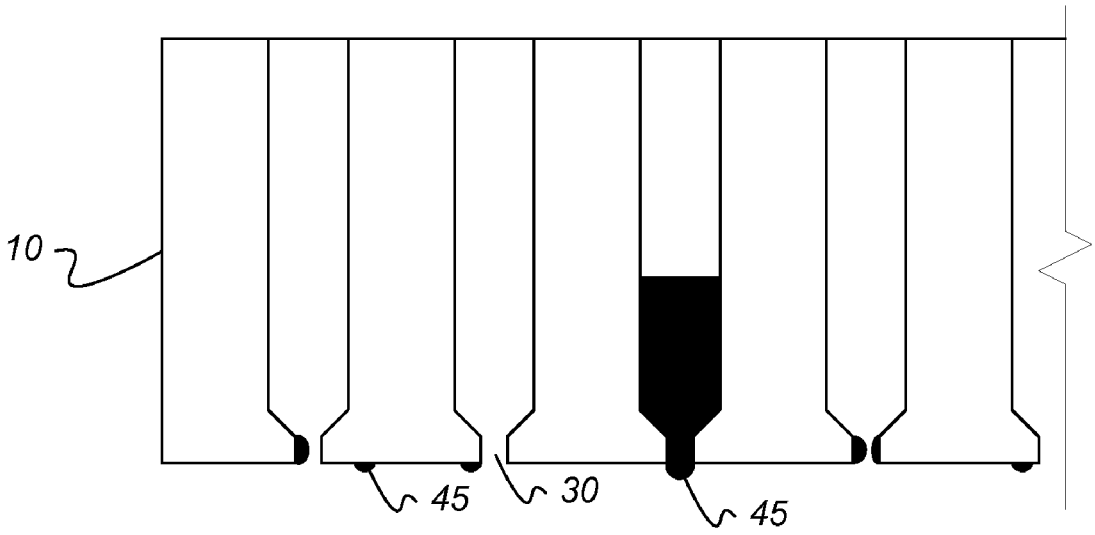
FIG. 2 schematically shows a cross sectional view of a printhead with cured ink on the surface.

Referring to FIG. 1, droplets of ink ejected from nozzles 30 in a printhead 10 can spray back onto the printhead plate. These droplets of ink, as well as any drops of ink that are not ejected from the nozzle that remain in the nozzle awaiting nozzle firing tend to accumulate in and around the nozzles and be cured by reflected radiation, such as radiation reflected off of the substrate. This can form cured ink 45 that partially or wholly blocks the nozzles 30, as shown in FIG. 2. In FIG. 2, the ink has been removed from the printhead after printing and only cured ink or ink blocked by the cured ink remains in view. Blocked nozzles can degrade the printing quality, such as by affecting the directionality of the droplets or entirely blocking the nozzle 30.

Figure 3:
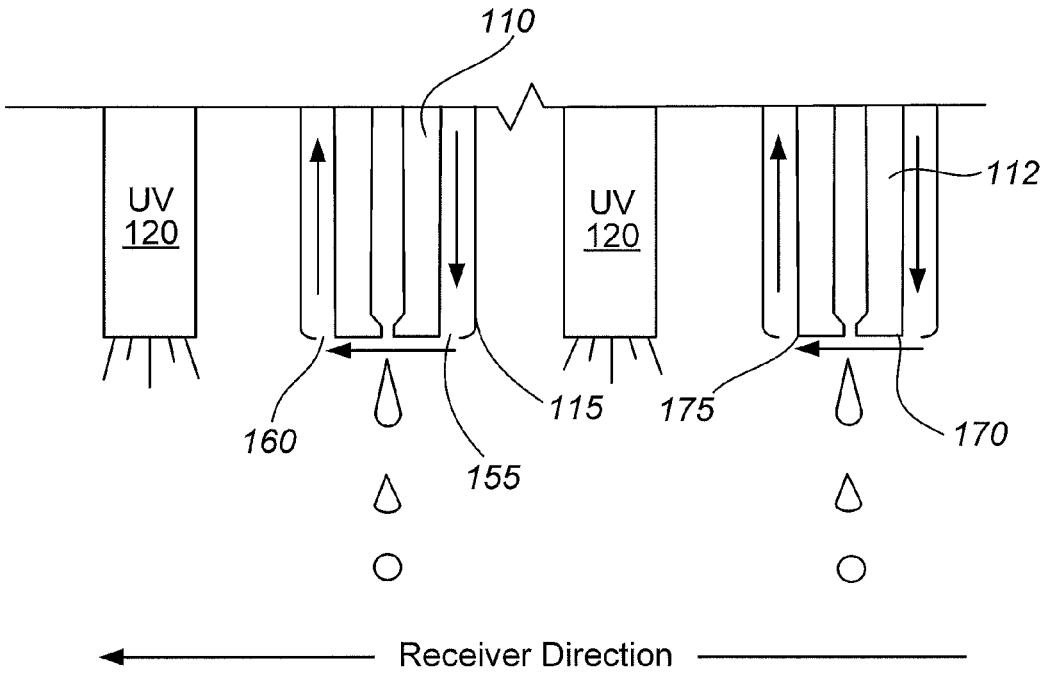
FIG. 3 is a schematic of a cross sectional view of a printer with multiple printheads and UV sources.

Referring to FIG. 3, a cross sectional side view of a printer shows printheads 110, 112, 114 and sources of UV radiation 120 positioned after each printhead 110, 112, 114 (i.e., along the direction of travel of the receiver). A printer can have one or more printbars or printheads parallel with one another (e.g., all perpendicular to the direction of travel of the receiver), depending on the type of printing that the printer is configured for, such as single color, four color, six color or other type of printing. One printhead 110 can eject a single color of ink, such as magenta, while another printhead 112 can eject a different color of ink, such as black. After the ink is ejected onto a receiver, a UV light source 120 cures the ink. The closer the UV light source 120 is to the location at which the drop is applied to the receiver, the faster the UV ink is cured and the sharper the image is that can be printed. However, the closer the UV light source 120 is to the printhead 110, the higher the likelihood that ink droplets that have reflected from the receiver and splattered onto the printhead will be cured on the printhead surface.

The printhead 110, or the housing 115 that contains the printhead, can include an outlet 155 for flowing the oxygen containing gas across the surface of the printhead. Optionally, an inlet 160 is included in the housing 115. Gas can be pushed through a duct along a sidewall of the printhead, delivered to an the outlet 155, and flowed along a surface of the printhead. If the housing including an inlet 160, the gas flows to the inlet 160 and then is pulled up along an opposite wall of the printhead. The gas can be pushed by an air source and pulled by a vacuum (not shown). The air source and vacuum can be an integral part of the printer or can be external and connected to the printer. The housing can hold a single printhead. The printhead can include a body through which the ink, or other fluid, is flowed. The vacuum can be supplied by a vacuum source, such as a vacuum pump within the printer or external to the printer. The air source can also be supplied by a pump or a pressurized source of gas. For example, gas can be supplied from outside the printer, such as from a high pressure gas cylinder or gas bombe through a pressure regulator. If air is the oxygen containing gas, an air pump can supply the gas. The oxygen containing gas can be air, oxygen ($O_2$) or a combination of oxygen and other gas, such as a gas that includes more than 21% oxygen, such as between about 30% and 80% oxygen, between about 40% and 60% oxygen or between about 60% and 80% oxygen. Decreased oxygen density, such as in an inert gas, can facilitate ink curing. Therefore, increasing the oxygen that any ink is exposed to decreases the likelihood of curing the ink.

Figure 4:
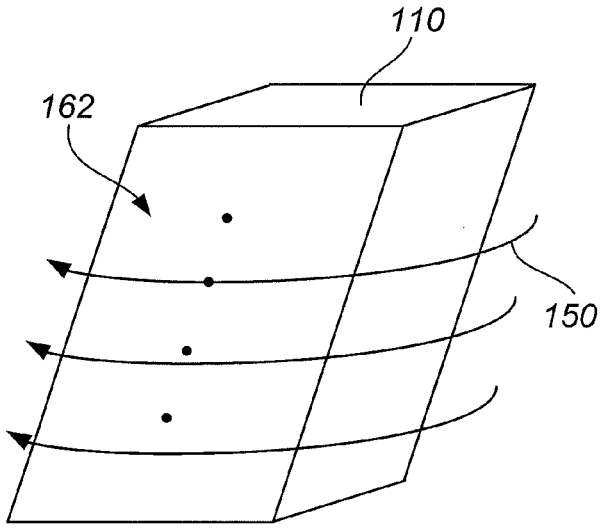
FIG. 4 is a schematic of a printhead in perspective view.

In some embodiments, the oxygen containing gas that is flowed over the surface of the printhead is flowed in the same direction as the direction of receiver travel during printing. That is, if the receiver is moving so that a stationary point on the receive is adjacent to a back edge 170 of the nozzle plate and is at a subsequent moment adjacent to a front edge 175 of the nozzle plate, then the oxygen containing gas flows across the face of the printhead from the back edge 170 to the front edge 175. The gas is flowed in a laminar manner across the printhead and only needs to cover the surface of the printhead. Referring to FIG. 4, the flow 150 for this embodiment goes down one side of the printhead 110, across the face 162 of the printhead 110 over the nozzles and back up an opposite side of the printhead. As the gas passes across the face 162, the flow is perpendicular to a direction of droplet ejection from the printhead. A suitable printhead with corresponding pumping chambers for ejecting the UV ink out of the nozzles is described in U.S. Publication No. US-2005-0099467-A1, published May 12, 2005, which is incorporated herein by reference.

Figure 5:
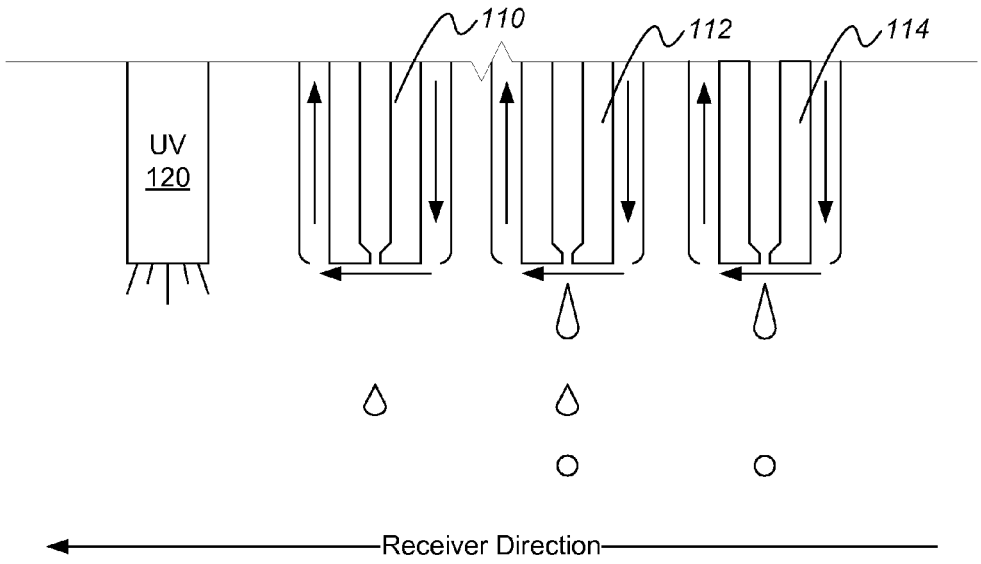
FIG. 5 is a schematic of a cross sectional view of a printer with multiple printheads and a single UV source.

Referring to FIG. 5, in some printers, instead of there being a UV light source 120 associated with each row of printheads or each print bar, the printer can include a single UV light source 120. A single UV light source 120 can allow for a smaller printer with less energy requirements. If the UV light is sufficient intense, either in energy or irradiance, one UV light source may be sufficient to cure all of the ink that is deposited on the receiver. However, if the light is not sufficient to cure ink prior to the next color being deposited, a single light source may allow for the ink droplets to mix or bleed into one another prior to cure. Each color of printhead or printbar can have its own source and vacuum (or inlet 155 and outlet 160) for oxygen containing gas. Alternatively, a single source and vacuum can be provided for each printbar.

Figure 6:
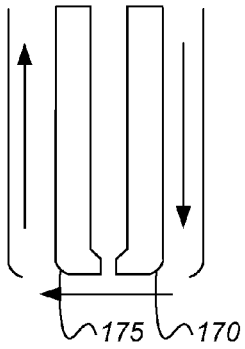
FIG. 6 is a schematic of a cross sectional view of a printhead with rounded corners.

Referring to FIG. 6, in some embodiments of the printheads, the front edge 175 of the nozzle plate, the back edge 170 of the nozzle plate or both are either rounded or chamfered, as opposed to squared, as is shown in FIG. 3. A rounded or chamfered corner can enable the fluid to flow smoothly over the printhead surface and maintain the oxygen containing gas close to the printhead, rather than turbulently flowing away from the printhead. Such corners can provide for laminar flow.

Figure 7:
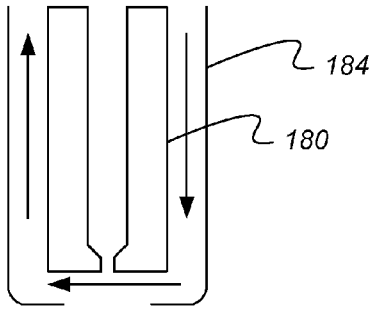
FIGS. 7 and 8 are schematics of a cross sectional view of printheads with a housing that extends below a surface of the printhead.

Referring to FIG. 7, the walls that contain the gas flow as the gas flows toward and away from the printhead face include a wall 180 that is proximate to the nozzles, and can be a wall of the printhead itself and a wall 184 that is distal to the nozzles, such as a wall of the printhead or a wall of the housing that holds the printhead. The proximate wall 180 can be the side wall of the printhead that the fluid flows along and can end at a position that is recessed from an end of the distal wall 184. Moreover, the distal wall 184 can extend down and around an edge of the face of the printhead, covering a portion of the printhead face. The extending distal wall 184 can also help direct the fluid flow around the face of the printhead. In some embodiments, the distal wall 184 is a housing wall and the printhead is held in a recessed position of the housing face to enable the housing to help direct the oxygen containing gas along the nozzle plate or printhead face.

In operation, the oxygen containing gas is flowing at a direction approximately perpendicular to the jetting direction of the ink. The fluid is flowed at a very slow rate to mitigate any changes in drop jetting direction. In some systems, the oxygen containing gas is flowed at a rate of less than about 10 m/s, such as less than about 5 m/s, less than 2 m/s, less than 1 m/s, less than 10 cm/s or less than 1 cm/s, such as about 1 mm/s. The oxygen containing gas is flowed at a rate sufficient to cover the surface of the printhead without being a fast flow.

Figure 8:
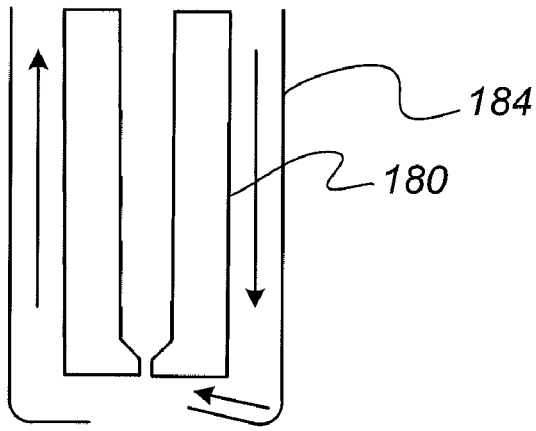

In some embodiments, the flow of gas supplied to the surface of the printhead is in a direction substantially parallel with the surface of the printhead or substantially perpendicular to the direction of drop ejection, substantially meaning within about 5 degrees or 10 degrees. In some embodiments, the flow of gas supplied to the surface of the printhead is at an angle to the direction that ink is ejected from the printhead, such as an angle greater than 0° and up to 120°, such as at a 90° angle. Because the oxygen containing air is intended on covering the surface of the nozzle plate to prevent ink curing on the nozzle plate, the direction of the gas flow is selected to cause the gas to remain near the nozzle plate rather than be directed toward the receiver. Referring to FIG. 8, the outlet for the gas flow can be modified to direct the gas toward the ink outlet.

Figure 9:
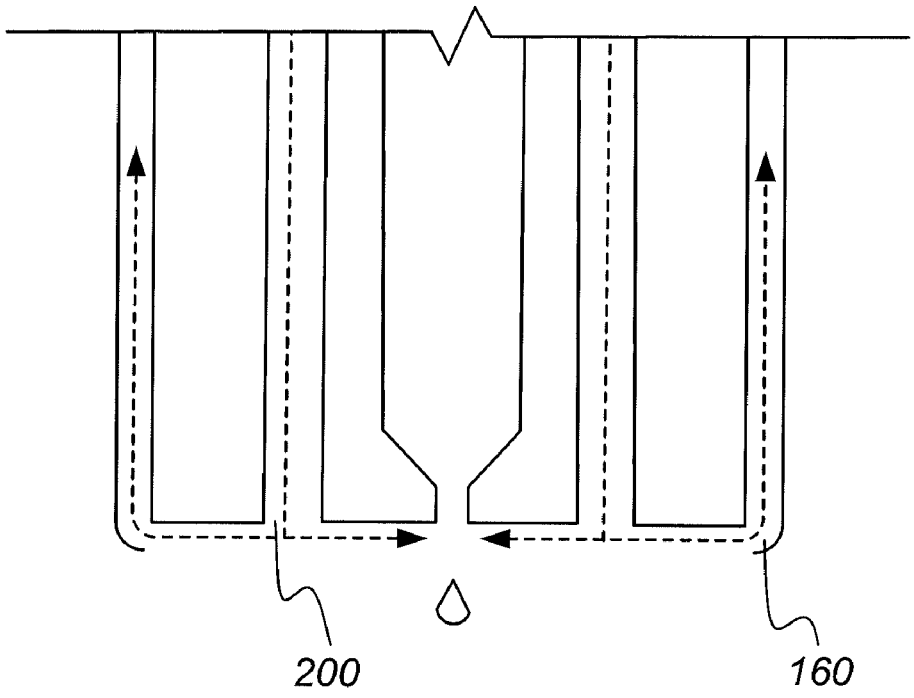
FIGS. 9 and 10 show cross sectional views of printheads with gas ducts extending through the printhead.
Figure 10:
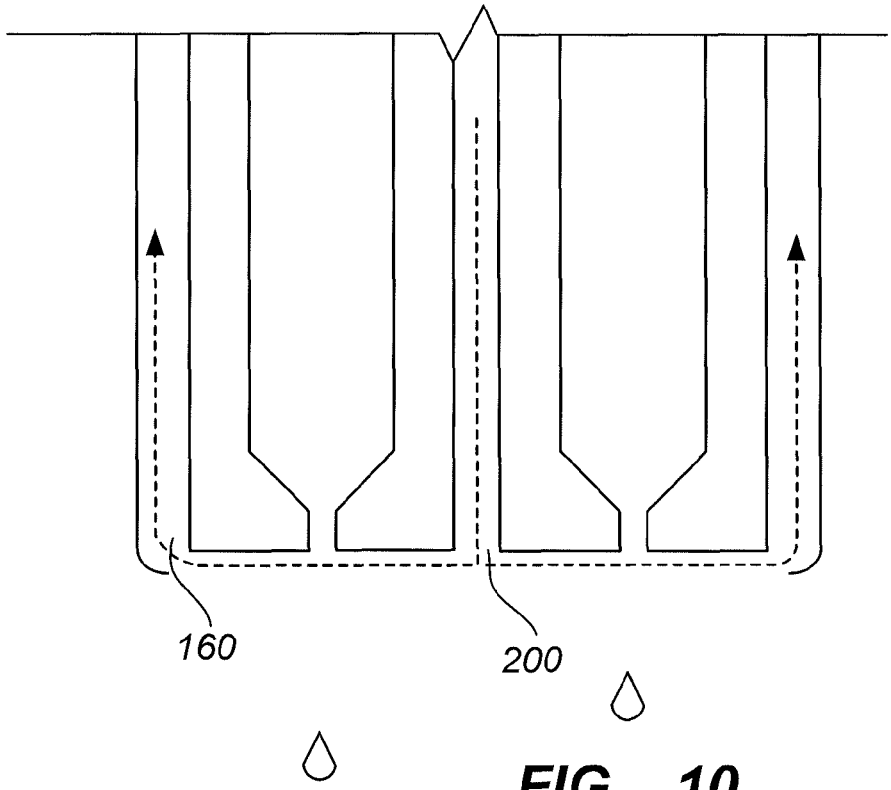
Figure 11:
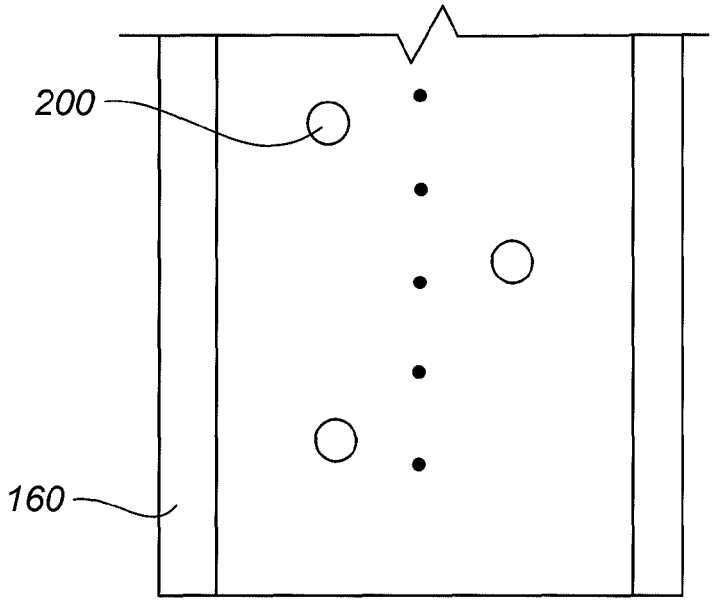
FIG. 11 is a bottom view of a printhead with gas ducts extending through the printhead.

Referring to FIGS. 9-11, in another embodiment, oxygen containing gas is flowed through the printhead. The gas exits apertures 200 that are on the same face of the printhead as the nozzles are located, that is, through the nozzle plate. In some embodiments, the ink and the gas exit from separate apertures in the nozzle plate and there is no other portion of the printhead or printing device through which the ink passes before contacting the receiver. An optional inlet for connection to a vacuum is on at lease one side of the printhead, and in some embodiments on both sides of the printhead. When the gas exits the printhead from the printhead face, the gas outlet apertures can be down a centerline of the printhead with nozzles on either side. Alternatively, the nozzles can be along the centerline of the printhead with the gas outlets on either side of the nozzles. Or, the gas outlets can be interspersed amongst the nozzles. Again, because the flow of the oxygen containing gas is very slow, the flow does not affect the direction of droplet ejection. That is, the trajectory of a droplet of ink ejected from the printhead is substantially the same when the gas is flowing as when the gas is not flowing.

Once printing is complete, the UV light source can be turned off or the printhead can be covered to prevent curing of the ink on the printhead surface. At this time, the flow of oxygen containing gas can also be turned off.

Figure 12:
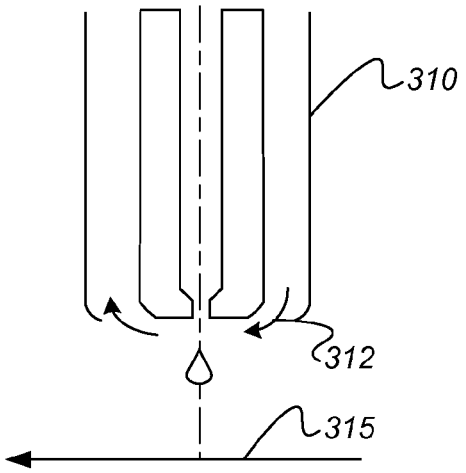
FIGS. 12 and 14 show schematics of a printhead with gas flow.
Figure 13:
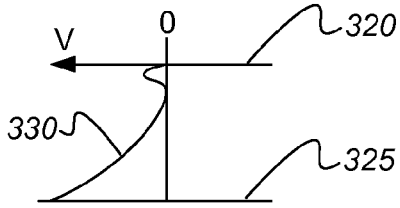
FIGS. 13 and 15 are graphs of the velocity of gas between the printhead and a receiver.

Referring to FIG. 12, a schematic of a printing device 310 with supplies an oxygen containing gas to the surface of a printhead is shown. The gas flow 312 direction is the same as the direction of the receiver movement 315 with respect to the printing device 310. As a droplet leaves the outlet of the printhead, the droplet passes through different velocities of gas flow, as shown in the graph in FIG. 13. The gas velocity 330 closest to the printhead surface 320 is theoretically zero. As the droplet moves away from the printhead surface 320, the gas flow velocity 330 increases. Further away from the printhead surface, the gas velocity 330 slows down. The highest velocity of the gas flow caused by the oxygen containing gas ejected from the printing device is close to the printhead and, in some embodiments, is closer to the printhead than the receiver. The gas velocity 330 then increases as the distance to the receiver increases. The receiver air flow 325, that is, the air flow cause by the travel of the receiver is the highest adjacent to the receiver. In some embodiments, the gas velocity 330 closest to the receiver is higher than the highest velocity of flow from the oxygen containing gas that is supplied by the printing device 310. In some embodiments, the highest velocity air flow caused by the receiver movement is at least twice as high as the velocity of air flow supplied by the printing device 310. Note that although the receiver is shown as moving, the receiver can be stationary and the printing device can move. The relative movement between the receiver can also be cause by moving the printing device.

Figure 14:
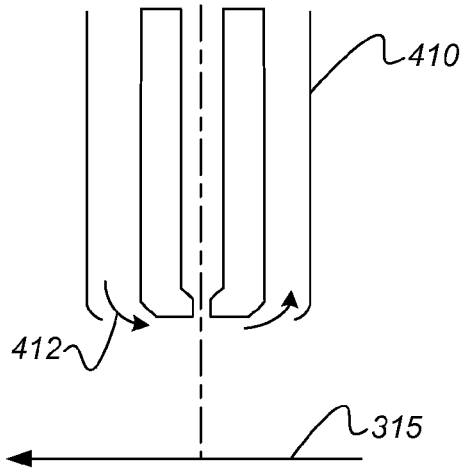
Figure 15:
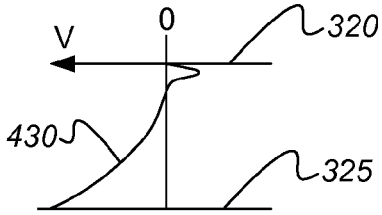

Referring to FIG. 14, a schematic of a printing device 410 that supplies an oxygen containing gas to the surface of a printhead is shown. Here, the gas flow 412 direction is opposite to the direction of the receiver movement 315 with respect to the printing device 410. As a droplet leaves the outlet of the printhead, the droplet passes through different velocities of gas flow, as shown in the graph in FIG. 15. The gas velocity 430 closest to the printhead surface 320 is theoretically zero. As the droplet moves away from the printehead surface 320, the gas flow velocity 430 increases in a direction opposite to the direction of receiver movement 315. Further away from the printhead surface, the gas velocity 430 slows down. The highest velocity of the gas flow caused by the oxygen containing gas ejected from the printing device is close to the printhead and, in some embodiments, is closer to the printhead than the receiver. The gas velocity 430 then increases as the distance to the receiver increases. However, the velocity increases in the direction of the receiver movement, opposite to the oxygen containing gas flow from the printing device. The receiver air flow 325, that is, the air flow cause by the travel of the receiver is the highest adjacent to the receiver. In some embodiments, the direction of the gas flow can be used to compensate any directionality error caused by air flow that the receiver movement causes.

Because of the oxygen containing gas being flowed proximate to the nozzles, the UV light source can be positioned close to the printhead. In some embodiments, the gas is flowed so that the gas does not reach the receiver and is only local to the printhead. This can maintain the ability of the UV curable components to be cured after they are applied to the receiver. The longer the time between printing and curing, the more likely the ink is to bleed or spread. Thus, it can be desirable to position the printing device and the energy source close together. That is, the UV light source is within 30 centimeters, such as 20 centimeters, 15 centimeters, 10 centimeters, 5 centimeters or within 2 centimeters of the printhead. The close proximity of the UV light source to the printhead and the oxygen containing gas being kept around the nozzles, but not on the receiver enables curing on the receiver immediately after droplet deposition without curing on the nozzle plate. Decreasing the distance between the UV light source and the printhead can improve sharpness of the image on the substrate because the deposited ink has little time to spread prior to being cured. The UV light source or sources can be housed within a housing that also contains the printhead. In some embodiments, the distance between printhead and the receiver during printing is between about 0.5 mm and 5 mm.

A number of embodiments of the invention have been described. Nevertheless, it will be understood that various modifications may be made without departing from the spirit and scope of the invention. For example, instead of an oxygen containing gas, the gas can be any gas that inhibits curing. Although flowing oxygen containing gas over the nozzles of ink jet printers having page width print bars is described, the components used herein can be used with scanning type printers and with continuous flow type printers. The vacuum source is optionally included. Without a vacuum source, the oxygen containing gas can be allowed to disperse away from the printhead. The nozzle plate can be exposed so that there are no other parts of the printhead between the nozzles and the receiver or receiver support. Although the methods described herein state that UV curable ink is ejected, other fluids that contain UV curable components can also or alternatively be ejected from the printheads or printing devices. Accordingly, other embodiments are within the scope of the following claims.

What is claimed is:

1. A printing device, comprising:

a gas source;

a printhead having a nozzle plate with nozzles in the nozzle plate, wherein the nozzles are fluidly connected to corresponding pumping chambers; and a gas outlet positioned adjacent to the nozzle plate, wherein the gas outlet is in fluid communication with the gas source and the gas outlet is configured to provide gas to an exposed surface of the nozzle plate so that the gas flow is substantially parallel to the surface of the nozzle plate, at least one edge of the nozzle plate along the exposed surface forming a part of the gas outlet, the at least one edge of the nozzle plate being rounded or chamfered to maintain the gas close to the exposed surface of the nozzle plate without turbulently flowing away from the printhead, wherein the gas source is configured to supply gas at a rate of less than 2 m/s.

2. The printing device of claim 1, further comprising:

a vacuum source; and an inlet positioned adjacent to the nozzle plate and on an opposite side from the gas outlet, wherein the inlet is in fluid communication with the vacuum source.

3. The printing device of claim 1, wherein the gas outlet is configured to provide laminar gas flow when gas is provided from the gas source.

4. The printing device of claim 1, wherein the printing device is a drop on demand type printing device.

5. A printing device, comprising:

a gas source;

a printhead having a nozzle plate with nozzles in the nozzle plate, wherein the nozzles are fluidly connected to corresponding pumping chambers;

a gas outlet positioned adjacent to the nozzle plate, wherein the gas outlet is in fluid communication with the gas source and the gas outlet is configured to provide gas to an exposed surface of the nozzle plate so that the gas flow is substantially parallel to the surface of the nozzle plate, at least one edge of the nozzle plate along the exposed surface forming a part of the gas outlet, the at least one edge of the nozzle plate being rounded or chamfered to maintain the gas close to the exposed surface of the nozzle plate without turbulently flowing away from the printhead; and a UV light source adjacent to the printhead.

6. The printing device of claim 5, wherein the UV light source is within 10 centimeters of the printhead.

7. The printing device of claim 6, wherein the UV light source is within 5 centimeters of the printhead.

8. A method of printing, comprising:

ejecting fluid from a nozzle in a printhead of a printing device along a trajectory and onto a receiver, wherein the printing device comprises:

a gas source;

the printhead having a nozzle plate with nozzles in the nozzle plate, wherein the nozzles are fluidly connected to corresponding pumping chambers; and a gas outlet positioned adjacent to the nozzle plate, wherein the gas outlet is in fluid communication with the gas source and the gas outlet is configured to provide gas to an exposed surface of the nozzle plate so that the gas flow is substantially parallel to the surface of the nozzle plate, at least one edge of the nozzle plate along the exposed surface forming a part of the gas outlet, the at least one edge of the nozzle plate being rounded or chamfered to maintain the gas close to the exposed surface of the nozzle plate without turbulently flowing away from the printhead; and while ejecting fluid from the nozzle, flowing oxygen containing gas across the nozzle plate at a rate sufficiently low to prevent flowing oxygen containing gas from changing the trajectory of the fluid ejected from the nozzle, wherein ejecting fluid includes ejecting UV curable ink, the method further comprising irradiating the ink on the receiver that has been ejected from the nozzle.

9. A method of, comprising:

ejecting fluid from a nozzle in a printhead of a printing device along a trajectory and onto a receiver, wherein the printing device comprises:

a gas source;

the printhead having a nozzle plate with nozzles in the nozzle plate, wherein the nozzles are fluidly connected to corresponding pumping chambers; and a gas outlet positioned adjacent to the nozzle plate, wherein the gas outlet is in fluid communication with the gas source and the gas outlet is configured to provide gas to an exposed surface of the nozzle plate so that the gas flow is substantially parallel to the surface of the nozzle plate, at least one edge of the nozzle plate along the exposed surface forming a part of the gas outlet, the at least one edge of the nozzle plate being rounded or chamfered to maintain the gas close to the exposed surface of the nozzle plate without turbulently flowing away from the printhead; and while ejecting fluid from the nozzle, flowing oxygen containing gas across the nozzle plate at a rate sufficiently low to prevent flowing oxygen containing gas from changing the trajectory of the fluid ejected from the nozzle, wherein flowing the oxygen containing gas comprises flowing gas that has more than 21% oxygen across the printhead.

10. The method of claim 9, wherein flowing oxygen containing gas includes blowing the oxygen containing gas out the gas outlet and suctioning the oxygen containing gas in at an inlet.

11. A printing device, comprising:

a gas source;

a printhead having a nozzle plate with nozzles in a surface, wherein the nozzles are fluidly connected to corresponding pumping chambers and the surface is exposed; and a gas outlet formed in the nozzle plate and in the same surface as the nozzles, wherein the gas outlet is in fluid communication with the gas source, the gas outlet is separate from the nozzles, wherein the gas source is configured to supply gas at a rate of less than 2 m/s.

12. The printing device of claim 11, wherein one edge of the nozzle plate forms a part of the gas outlet.

13. The printing device of claim 11, wherein the printing device is a drop on demand type printing device.

14. The printing device of claim 11, further comprising a UV light source adjacent to the printhead.

15. The printing device of claim 14, wherein the UV light source is within 10 centimeters of the printhead.

16. The printing device of claim 15, wherein the UV light source is within 5 centimeters of the printhead.

17. The printing device of claim 11, further comprising additional gas outlets interspersed amongst nozzles in the surface.

18. A printing device, comprising:

a gas source;

a printhead having a nozzle plate with nozzles in a surface, wherein the nozzles are fluidly connected to corresponding pumping chambers and the surface is exposed; and a gas outlet formed in the nozzle plate and in the same surface as the nozzles, wherein the gas outlet is in fluid communication with the gas source, the gas outlet is separate from the nozzles, wherein one edge of the nozzle plate forms a part of the gas outlet, and at least one edge of the nozzle plate is rounded.

19. A printing device, comprising:

a gas source;

a printhead having a nozzle plate with nozzles in a surface, wherein the nozzles are fluidly connected to corresponding pumping chambers and the surface is exposed; and a gas outlet formed in the nozzle plate and in the same surface as the nozzles, wherein the gas outlet is in fluid communication with the gas source, the gas outlet is separate from the nozzles, wherein one edge of the nozzle plate forms a part of the gas outlet, and at least one edge of the nozzle plate is chamfered.

20. A method of printing, comprising:

ejecting fluid from a nozzle in a printhead of a printing device along a trajectory and onto a receiver, wherein the printing device comprises:

a gas source;

the printhead having a nozzle plate with nozzles in a surface, wherein the nozzles are fluidly connected to corresponding pumping chambers and the surface is exposed; and a gas outlet formed in the nozzle plate and in the same surface as the nozzles, wherein the gas outlet is in fluid communication with the gas source, the gas outlet is separate from the nozzles; and while ejecting fluid from the nozzle, flowing oxygen containing gas across the nozzle plate at a rate sufficiently low to prevent flowing oxygen containing gas from changing the trajectory of the fluid ejected from the nozzle.

21. The method of claim 20, wherein ejecting fluid includes ejecting UV curable ink, the method further comprising irradiating the ink on the receiver that has been ejected from the nozzle.

22. The method of claim 20, flowing oxygen containing gas includes blowing the oxygen containing gas out the gas outlet and suctioning the oxygen containing gas in at an inlet.

23. The method of claim 20, wherein flowing the oxygen containing gas comprises flowing gas that has more than 21% oxygen across the printhead.

* * * * *

UNITED STATES PATENT AND TRADEMARK OFFICE

CERTIFICATE OF CORRECTION

PATENT NO. : 8,262,192 B2
APPLICATION NO. : 12/372477
DATED : September 11, 2012
INVENTOR(S) : Nobuo Matsumoto It is certified that error appears in the above-identified patent and that said Letters Patent is hereby corrected as shown below:

In the Claims:

At Column 8, Line 47, in Claim 9, first line, delete "of," and insert -- of printing, --, therefor.

Signed and Sealed this
Thirtieth Day of April, 2013

Teresa Stanek Rea
*Acting Director of the United States Patent and Trademark Office*